US010774847B2

(12) United States Patent
Krissak et al.

(10) Patent No.: US 10,774,847 B2
(45) Date of Patent: Sep. 15, 2020

(54) PRESSURE AMPLIFIER

(71) Applicant: PistonPower ApS, Soenderborg (DK)

(72) Inventors: Peter Krissak, Zilina (SK); Jorgen Mads Clausen, Soenderborg (DK); Peter Zavadinka, Chocholna-Velice (SK)

(73) Assignee: PISTONPOWER APS, Soenderborg (DK)

( * ) Notice: Subject to any disclaimer, the term of this patent is extended or adjusted under 35 U.S.C. 154(b) by 303 days.

(21) Appl. No.: 15/909,254

(22) Filed: Mar. 1, 2018

(65) Prior Publication Data

US 2018/0252206 A1 Sep. 6, 2018

(30) Foreign Application Priority Data

Mar. 3, 2017 (EP) ..... 17159045

(51) Int. Cl.
*F15B 3/00* (2006.01)
*F01L 25/06* (2006.01)
(Continued)

(52) U.S. Cl.
CPC ..... *F15B 3/00* (2013.01); *F01L 25/063* (2013.01); *F04B 9/1056* (2013.01); *F04B 9/113* (2013.01); *F04C 11/003* (2013.01); *F04F 13/00* (2013.01)

(58) Field of Classification Search
CPC ..... F15B 3/00; F04B 9/1056; F04C 11/003; F04F 13/00
(Continued)

(56) References Cited

U.S. PATENT DOCUMENTS 2,991,130 A 1/1961 Sampietro
3,037,488 A * 6/1962 Barrett ..... F03C 1/0409 91/498
(Continued)

FOREIGN PATENT DOCUMENTS

CN 203348188 U 12/2013
CN 103511382 A 1/2014
(Continued)

OTHER PUBLICATIONS

First Examination Report for Indian Serial No. 201814004324 dated Feb. 28, 2020.

*Primary Examiner* — Peter J Bertheaud
(74) *Attorney, Agent, or Firm* — McCormick, Paulding & Huber PLLC

(57) ABSTRACT

A pressure amplifier (1) is described comprising a housing (2) a low pressure chamber (9-12), a high pressure chamber (13-16) and for transmitting means between the low pressure chamber (9-12) and the high pressure chamber (13-16). Such a pressure amplifier should have a compact design. To this end the force transmitting means comprise a rotor (3) arranged in a bore (4) of the housing (2), wherein the rotor (3) comprises a radially extending low pressure wing (5, 6) and a radially extending high pressure wing (7, 8), the low pressure wing (5, 6) together with the housing (2) delimiting the low pressure chamber (9-12) and the high pressure wing (7, 8) together with the housing (2) delimiting the high pressure chamber (13-16), wherein a supply of fluid into the low pressure chamber (9-12) causes a rotation of the rotor (3) and a rotation of the rotor causes a decrease of volume of the high pressure chamber (13-16).

20 Claims, 1 Drawing Sheet

(51) Int. Cl.

| | |
|---|---|
| ***F04F 13/00*** | (2009.01) |
| ***F04C 11/00*** | (2006.01) |
| ***F04B 9/105*** | (2006.01) |
| ***F04B 9/113*** | (2006.01) |

(58) Field of Classification Search
USPC ..... 417/64, 225
See application file for complete search history.

(56) References Cited

U.S. PATENT DOCUMENTS

| | | | | |
|---|---|---|---|---|
| 3,079,864 | A * | 3/1963 | Drutchas | F04B 9/113 417/225 |
| 3,081,706 | A * | 3/1963 | Drutchas | F04C 11/005 417/204 |
| 3,241,463 | A * | 3/1966 | Barrett | F03O 1/0457 92/12.1 |
| 3,391,538 | A * | 7/1968 | Orloff | F01B 1/0689 417/348 |
| 3,579,985 | A * | 5/1971 | Barrett | F01B 13/065 60/419 |
| 3,583,832 | A | 6/1971 | Lee, II | |
| 3,632,230 | A | 1/1972 | Ueda | |
| 3,835,752 | A * | 9/1974 | D'Amata | F04B 1/10 91/492 |
| 4,523,895 | A | 6/1985 | Silva | |
| 4,627,794 | A | 12/1986 | Silva | |
| 4,659,294 | A | 4/1987 | Barthomeuf | |
| 4,780,064 | A | 10/1988 | Olsen | |
| 6,497,558 | B1 | 12/2002 | Hale | |
| 6,619,243 | B2 * | 9/2003 | Al-Hawaj | F01B 13/04 123/430 |
| 6,866,485 | B2 | 3/2005 | Hansen et al. | |
| 7,726,950 | B2 * | 6/2010 | Hansen | F04B 9/107 417/225 |
| 2003/0097924 | A1 | 5/2003 | Hansen et al. | |
| 2003/0172652 | A1 | 9/2003 | Tohru | |
| 2005/0013716 | A1 | 1/2005 | Magami et al. | |
| 2005/0123416 | A1 | 6/2005 | Smith | |
| 2006/0073037 | A1 | 4/2006 | Pedersen et al. | |
| 2009/0317267 | A1 | 12/2009 | Gill et al. | |
| 2014/0373524 | A1 | 12/2014 | Schuller et al. | |
| 2016/0053749 | A1 | 2/2016 | Hunter | |
| 2018/0252240 | A1 | 9/2018 | Vokel et al. | |
| 2018/0252241 | A1 | 9/2018 | Todsen et al. | |
| 2018/0252242 | A1 | 9/2018 | Hanusovsky et al. | |

FOREIGN PATENT DOCUMENTS

| | | | |
|---|---|---|---|
| CN | 203757349 | U | 8/2014 |
| DE | 3032430 | A1 | 3/1982 |
| DE | 102007031166 | A1 | 1/2009 |
| EP | 0692072 | B1 | 9/1999 |
| JP | S6224001 | A | 2/1987 |
| JP | S63243464 | A | 10/1988 |
| RU | 2056550 | C1 | 3/1996 |
| RU | 19404 | U1 | 8/2001 |
| RU | 24520 | U1 | 8/2002 |
| RU | 2513060 | C1 | 4/2014 |
| SU | 638751 | A1 | 12/1978 |
| SU | 1165818 | A1 | 7/1985 |

* cited by examiner

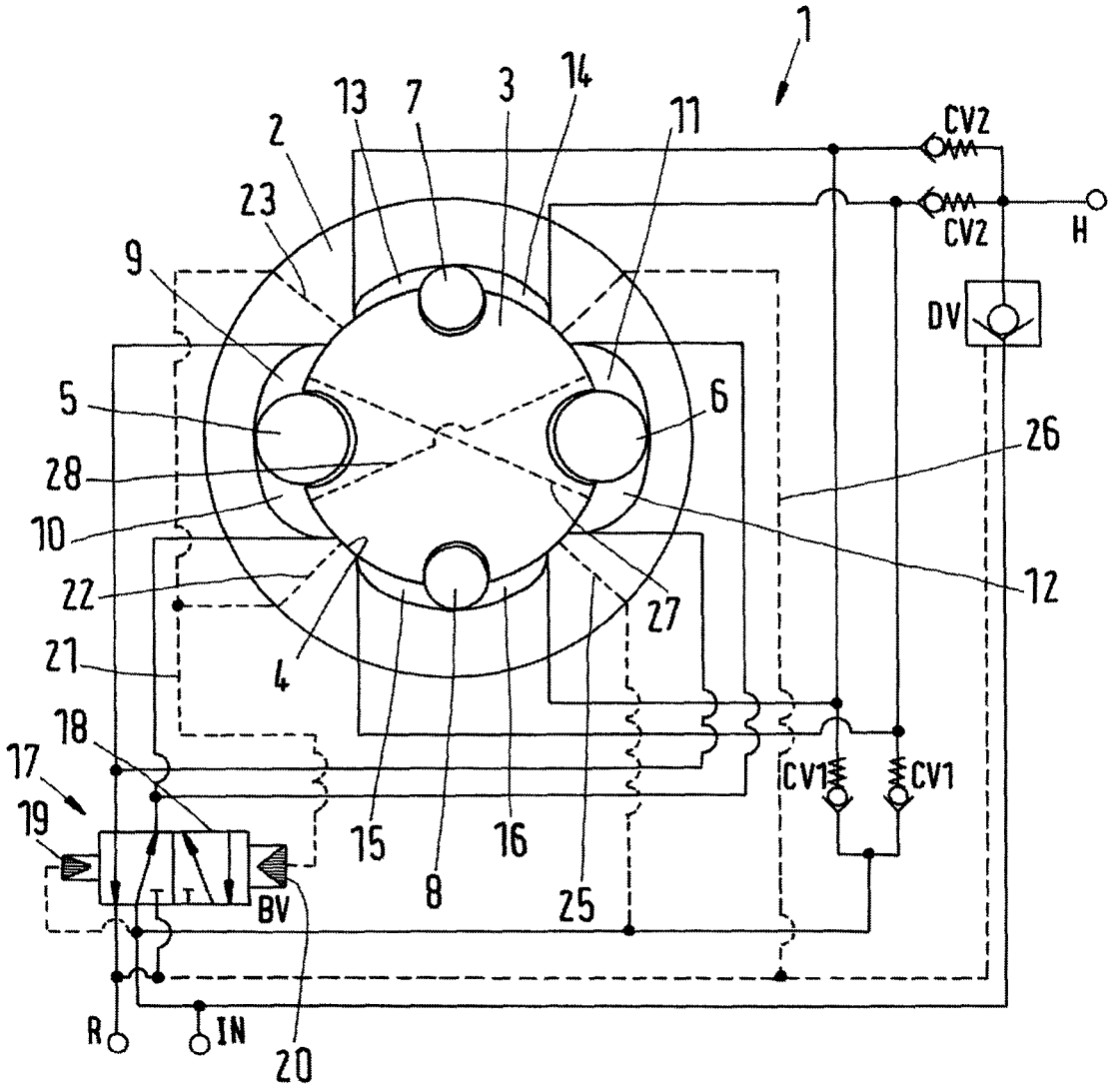
1
2
3
4
5
6
7
8
9
10
11
12
13
14
15
16
17
18
19
20
21
22
23
25
26
27
28
CV2
CV2
H
DV
CV1
CV1
BV
R
IN

PRESSURE AMPLIFIER

CROSS-REFERENCE TO RELATED APPLICATION

This application claims foreign priority benefits under U.S.C. § 119 to European Patent Application No. 17159045.8 filed on Mar. 3, 2017, the content of which is hereby incorporated by reference in its entirety.

TECHNICAL FIELD

The present invention relates to a pressure amplifier comprising a housing, a low pressure chamber, a high pressure chamber and force transmitting means between the low pressure chamber and the high pressure chamber.

BACKGROUND

Such a pressure amplifier is known, for example, from U.S. Pat. No. 6,866,485 B2. The force transmitting means is formed by a stepped piston. The stepped piston has a larger low pressure area in the low pressure chamber and a smaller high pressure area in the high pressure chamber. When the low pressure chamber is supplied with a fluid under pressure a force is generated shifting the piston in a direction to decrease the volume of the high pressure chamber. The force is basically the product of the low pressure area and the pressure in the low pressure chamber. This force leads to a pressure in the high pressure chamber which is basically the force divided by the high pressure area.

SUMMARY

The object underlying the invention is to have a pressure amplifier having a compact design.

This object is solved with a pressure amplifier as described at the outset in that the force transmitting means comprise a rotor arranged in a bore of the housing, wherein the rotor comprises a radially extending low pressure wing and a radially extending high pressure wing, the low pressure wing together with the housing delimiting the low pressure chamber, and the high pressure wing together with the housing delimiting the high pressure chamber, wherein a supply of fluid into the low pressure chamber causes a rotation of the rotor and a rotation of the rotor causes a decrease of volume of the high pressure chamber.

The force transmitting means perform a rotational movement only. Such a rotational movement does not require a space needed for a stroke of a piston.

In an embodiment of the invention the low pressure wing is located between a pair of two low pressure chambers and the high pressure wing is located a pair of two high pressure chambers. In this way the pressure amplifier is a double acting amplifier delivering pressurized fluid in both rotational directions.

In an embodiment of the invention the rotor comprises at least two low pressure wings arranged in a corresponding number of pairs of low pressure chambers and at least two high pressure wings arranged in a corresponding numbers of pairs of high pressure chambers. This increases a possible output of the pressure amplifier.

In an embodiment of the invention in circumferential direction a low pressure wing is followed by a high pressure wing and a high pressure wing is followed by a low pressure wing. This embodiment has a good force distribution.

In an embodiment of the invention the low pressure wings are arranged symmetrically to each other and/or the high pressure wings are arranged symmetrically to each other. The forces acting on the rotational axis of the rotor are balanced so that friction can be kept low.

In an embodiment of the invention the pairs of low pressure chambers are arranged symmetrically to each other and/or the pairs of high pressure chambers are arranged symmetrically to each other. This allows for a symmetric distribution of forces on the rotor as well.

In an embodiment of the invention the low pressure wings have a larger pressure area than the high pressure wings. In a somewhat simplified manner it can be said that the ratio of the pressures between the low pressure chamber and the high pressure chamber corresponds to the ratio of the pressure area of the low pressure wing divided by the pressure area of the high pressure wing.

In an embodiment of the invention the low pressure wing has a first radial length and the high pressure wing has a second radial length, wherein the first radial length is larger than the second radial length. This is one way to establish different pressure areas of the wings.

In an embodiment the low pressure wing has a first axial length and the high pressure wing has a second axial length, wherein the first axial length is larger than the second axial length. This axial length has as well an influence of the size of the pressure area.

In an embodiment of the invention the low pressure wing and/or the high pressure wing are in form of rollers. The rollers have only a contact line with the interior of the housing which keeps friction low.

In an embodiment of the invention the rollers are rotatably supported in the rotor. This keeps friction small as well.

In an embodiment of the invention a pressure control switching valve is provided controlling a supply of fluid to one low pressure chamber of the pair of low pressure chambers, wherein the rotor comprises at least a connection channel which in a first rotary end position of the rotor connects a control port of the switching valve with a first pressure and in a second rotary end position of the rotor connects the control port of the switching valve with a second pressure, wherein the first pressure is higher than the second pressure. By means of the connection channel the pressure difference over the switching valve can be changed to provoke switching of the switching valve.

In an embodiment of the invention in intermediate positions of the rotor between the first rotary end position and the second rotary end positions the connection channel connects to low pressure chambers of different pairs of low pressure chambers. The pressure in the respective low pressure chambers can be equalized.

In an embodiment of the invention in the intermediate positions of the rotor the rotor interrupts a connection between the first or second pressure, respectively, and the control port of the switching valve. As long as the rotor rotates, the switching position of the switching valve is not changed.

In an embodiment of the invention the housing is part of a piston-cylinder-unit.

BRIEF DESCRIPTION OF THE DRAWING

An embodiment of the invention will now be described in more detail with reference to the drawing, wherein:

The only FIGURE schematically shows a pressure amplifier.

DETAILED DESCRIPTION

A pressure amplifier 1 which can also be named "pressure intensifier" comprises a housing 2 and a rotor 3 rotatably supported in a bore 4 of the housing 2.

The rotor 3 comprises a first low pressure wing in form of a low pressure roller 5 and a second low pressure wing in form of a low pressure roller 6. The rollers 5, 6 are arranged symmetrically to each other. Furthermore, the rotor 3 comprises a first high pressure wing in form of a high pressure roller 7 and a second high pressure wing in form of a high pressure roller 8. The rollers 7, 8 are arranged symmetrically with respect to each other. The rollers 5-8 are supported rotatably within the rotor 3.

The low pressure roller 5 forming the first low pressure wing is located between a pair of two low pressure chambers 9, 10. The low pressure roller 6 forming the second low pressure wing is arranged between two low pressure chambers 11, 12. The low pressure chambers 9-12 are delimited by the rotor 3, the respective low pressure roller 5, 6 and the housing 2.

In a similar way the roller 7 forming the first high pressure wing is arranged between two high pressure chambers 13, 14 and the roller 8 forming the second high pressure wing is arranged between two high pressure chambers 15, 16. The high pressure chambers 13-16 are delimited by the high pressure rollers 7, 8, the rotor 3 and the housing 2.

When, for example, the low pressure chambers 10, 11 are supplied with fluid, the rotor 3 is rotated in a clockwise direction (as shown in the FIGURE) and the volume of the high pressure chambers 14, 15 is decreased.

Since the pressure area of the low pressure rollers 5, 6 is larger than the corresponding pressure area of the high pressure roller 7, 8 the pressure in the high pressure chambers 14, 15 is correspondingly increased. The intensification ratio between the pressure in the low pressure chambers 10, 11 and the pressure in the high pressure chambers 14, 15 is basically defined by the ratio between the diameter of the low pressure rollers 5, 6 and the high pressure rollers 7, 8. There is a small deviation due to differences between the low pressure and the high pressure force axial length.

Furthermore, the axial lengths of the low pressure rollers 5, 6 can be made larger than the axial length of the high pressure rollers 7, 8. This again leads to an increase of the low pressure area in the low pressure chamber and to a corresponding pressure intensification in the high pressure chambers 13-16.

When the two other low pressure chambers 9, 12 are supplied with fluid, the rotor 3 is rotated counter clockwise and correspondingly fluid under a higher pressure is outputted from the other two high pressure chambers 13, 16.

The pressure amplifier 1 is a double acting pressure amplifier having minimal flow ripples.

Furthermore, it has a high frequency and therefore a high flow capability. Due to the use of rollers 5-8 there are minimal friction losses.

Since the low pressure chambers 9-12 and the high pressure chambers 13-16 respectively, are arranged symmetrically with respect to the rotor 3, the forces acting on the rotor 3 perpendicular to an axis of the rotor 3 are balanced so that friction losses in the bearings of the rotor 3 (not shown) can be kept at a minimum as well.

The pressure amplifier 1 is ideal for micro hydraulic and for smart electro-hydraulic solutions. It is furthermore ideal for module design.

The drawing shows the piping of the pressure amplifier 1 as well.

The pressure amplifier 1 comprises a switching valve 17 which is pressure controlled. The switching valve 17 comprises a schematically shown valve element 18 which can be switched between a first position (shown in the FIGURE) and a second position. To this end the switching valve 17 comprises a first control port 19 which is loaded by a constant pressure. The constant pressure is a supply pressure supplied via a port IN to the pressure amplifier 1. Furthermore, the switching valve comprises a second control port 20. The second control port 20 has a larger pressure area than the first control port 19. The operation of the switching valve 17 will be explained below.

In the first position shown in the drawing the pressure of the inlet port IN is supplied to the low pressure chamber 10 and to the low pressure chamber 11. Furthermore the switching valve 17 switches a path from the other two low pressure chambers 9, 12 to a return port R of the pressure amplifier 1. The inlet port IN is likewise connected to the high pressure chambers 13-16 via check valves CV1 and to a high pressure outlet H via check valves CV2.

The second control part 20 of the switching valve 17 is connected to a control line 21 having a first branch 22 and a second branch 23. A first branch opens into the bore 4 at a position between the low pressure chamber 10 and the high pressure chamber 15. The second branch 23 opens into the bore at a position between the low pressure chamber 9 and the high pressure chamber 13.

A high pressure control line 25 is connected to the input port IN and a low pressure control line 26 is connected to the return port R.

The high pressure control line 25 opens into bore 4 in a position between the high pressure chamber 16 and the low pressure chamber 12. Furthermore the low pressure control line 26 opens into bore 4 in a position between the high pressure chamber 14 and the low pressure chamber 11.

The rotor 3 has a first connection channel 27 and a second connection channel 28. In a first rotary end position of the rotor 3 the first connection channel 27 connects the second branch 23 of the first control line 21 and the high pressure control line 25. In a second rotary end position of the rotor 3 the second connection channel 28 connects the first branch 22 of the first control line 21 with the low pressure control line 26.

In all intermediate positions of the rotor 3 the branches 22, 23, and the control lines 25, 26 are closed by the rotor 3.

In the position of the switching valve 17 shown in the drawing supply pressure from the inlet port IN is supplied to the low pressure chambers 10, 11 which causes a rotation of the rotor 3 in a clockwise direction. Therefore, fluid with a high pressure is outputted from the high pressure chambers 14, 15 via one of the two check valves CV2 to the high pressure port H. At the same time the remaining high pressure chambers 13, 16 are filled with fluid from the inlet port IN via one of the check valves CV1. This is possible because upon a rotation of rotor 3 in clockwise direction the pressure in the high pressure chambers 13, 16 is below the supply pressure at the input port IN.

When the rotor 3 has reached its end position in the clock wise direction the first connection channel connects the high pressure control line 25 and the second branch 23 of the first control line 21 which in turn is connected to the second control port 20 of the switching valve 17. Now both control ports 19, 20 receive the same pressure, i. e. the supply pressure at the inlet port IN. However, since the second control port 20 has a larger pressure area than the first control port 19, the valve element 18 is shifted in the other position in which the inlet port IN is connected to the other low pressure chambers 9, 12. In this case the rotor 3 is rotated in counter clock wise direction and fluid under higher pressure is pressed out of the high pressure chambers 13, 16 to arrive via the other of the check valves CV2 at the high pressure port H. At the same time the remaining high pressure chambers 14, 15 are filled with fluid from the inlet port IN via the other of the check valves CV1.

When the rotor 3 reaches its end position in counter clock wise direction the second connection channel 28 connects the first branch 22 of control line 21 to the low pressure control line 26 thereby decreasing the pressure at the second control port 20 of the switching valve 17 to the pressure at the return port R. The pressure of the input port IN now shifts the valve element 18 of the switching valve in the position shown.

In a way not shown in the drawing, the pressure amplifier 1 can be built into a piston-cylinder-unit, in particular into the cylinder of the piston-cylinder-unit.

Furthermore, the switching valve 17 can be integrated into housing 2.

It is possible to extend the axial length of the rollers 5-8 which makes it possible to increase the output volume of the pressure amplifier.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A pressure amplifier comprising a housing, a low pressure chamber, a high pressure chamber and force transmitting means between the low pressure chamber and the high pressure chamber, wherein the force transmitting means comprises a rotor arranged in a bore of the housing, wherein the rotor comprises a radially extending low pressure wing and a radially extending high pressure wing, the low pressure wing together with the housing delimiting the low pressure chamber, and the high pressure wing together with the housing delimiting the high pressure chamber, wherein a supply of fluid into the low pressure chamber causes a rotation of the rotor and a rotation of the rotor causes a decrease of volume of the high pressure chamber.

2. The pressure amplifier according to claim 1, wherein the low pressure wing is located between a pair of two low pressure chambers and the high pressure wing is located between a pair of two high pressure chambers.

3. The pressure amplifier according to claim 1, wherein the rotor comprises at least two low pressure wings arranged in a corresponding number of pairs of low pressure chambers and at least two high pressure wings arranged in a corresponding number of pairs of high pressure chambers.

4. The pressure amplifier according to claim 3, wherein in circumferential direction a low pressure wing is followed by a high pressure wing and a high pressure wing is followed by a low pressure wing.

5. The pressure amplifier according to claim 3, wherein the low pressure wings are arranged symmetrically to each other and/or the high pressure wings are arranged symmetrically to each other.

6. The pressure amplifier according to claim 3, wherein the pairs of low pressure chambers are arranged symmetrically to each other and/or the pairs of high pressure chambers are arranged symmetrically to each other.

7. The pressure amplifier according to claim 1, wherein the low pressure wing has a larger pressure area than the high pressure wing.

8. The pressure amplifier according to claim 7, wherein the low pressure wing has a first radial length and the high pressure wing has a second radial length, wherein the first radial length is larger than the second radial length.

9. The pressure amplifier according to claim 7, wherein the low pressure wing has a first axial length and the high pressure wing has a second axial length, wherein the first axial length is larger than the second axial length.

10. The pressure amplifier according to claim 1, wherein the low pressure wing and/or the high pressure wing are in form of rollers.

11. The pressure amplifier according to claim 10, wherein the rollers are rotatably supported in the rotor.

12. The pressure amplifier according to claim 2, wherein a pressure controlled switching valve is provided controlling the supply of fluid to one low pressure chamber of the pair of low pressure chambers, wherein the rotor comprises at least a connection channel which in a first rotary end position of the rotor connects a control port of the switching valve with a first pressure and in a second rotary end position of the rotor connects the control port of the switching valve with a second pressure, wherein the first pressure is higher than the second pressure.

13. The pressure amplifier according to claim 12, wherein in an intermediate position of the rotor between the first rotary end position and the second rotary end position the connection channel connects two low pressure chambers of different pairs of low pressure chambers.

14. The pressure amplifier according to claim 13, wherein in the intermediate position of the rotor the rotor interrupts a connection between the first or second pressure, respectively, and the control port of the switching valve.

15. The pressure amplifier according to claim 1, wherein the housing is part of a piston-cylinder-unit.

16. The pressure amplifier according to claim 2, wherein the rotor comprises at least two low pressure wings arranged in a corresponding number of pairs of low pressure chambers and at least two high pressure wings arranged in a corresponding number of pairs of high pressure chambers.

17. The pressure amplifier according to claim 4, wherein the low pressure wings are arranged symmetrically to each other and/or the high pressure wings are arranged symmetrically to each other.

18. The pressure amplifier according to claim 4, wherein the pairs of low pressure chambers are arranged symmetrically to each other and/or the pairs of high pressure chambers are arranged symmetrically to each other.

19. The pressure amplifier according to claim 5, wherein the pairs of low pressure chambers are arranged symmetrically to each other and/or the pairs of high pressure chambers are arranged symmetrically to each other.

20. The pressure amplifier according to claim 2, wherein the low pressure wing has a larger pressure area than the high pressure wing.

* * * * *